United States Patent [19]

Herbert

[11] Patent Number: 4,981,448

[45] Date of Patent: Jan. 1, 1991

[54] FUSE HOLDER

[75] Inventor: William G. Herbert, Ellisville, Mo.

[73] Assignee: Cooper Industries, Inc., Houston, Tex.

[21] Appl. No.: 361,841

[22] Filed: Jun. 2, 1989

Related U.S. Application Data

[63] Continuation-in-part of Ser. No. 173,410, Mar. 25, 1988.

[51] Int. Cl.[5] ..... H01R 13/68

[52] U.S. Cl. ..... 439/622

[58] Field of Search ..... 439/622, 488

[56] References Cited

U.S. PATENT DOCUMENTS

| | | | |
|---|---|---|---|
| 3,891,292 | 6/1975 | Blight et al. | 439/488 X |
| 4,060,303 | 11/1977 | Wilczynski | 339/147 |
| 4,072,385 | 2/1978 | Wallner | 339/88 |
| 4,390,225 | 6/1983 | Coyne et al. | 439/622 X |
| 4,448,476 | 5/1984 | Perlman et al. | 339/203 |
| 4,504,815 | 3/1985 | Harwarth | 439/622 X |
| 4,536,054 | 8/1985 | Wallner et al. | 439/622 X |
| 4,738,639 | 4/1988 | Henderson | 439/622 |
| 4,826,454 | 5/1989 | Kissling et al. | 439/621 |

OTHER PUBLICATIONS

Page from Bussman April 1988 catalog showing fuseholders.

*Primary Examiner*—Eugene F. Desmond
*Attorney, Agent, or Firm*—Donald J. Verplancken; David A. Rose; Ned L. Conley

[57] ABSTRACT

The fuse holder for receiving a cylindrical fuse having conductive ends includes a cap having a fuse carrier disposed in part therein for receiving one end of the fuse and a barrel having a fuse cavity for receiving the cap and fuse. The fuse carrier includes a spring retainer for retaining the fuse within the carrier. The barrel includes a bottom terminal extending through the barrel for contact with one conductive end of the fuse and a side terminal having tines extending through apertures in the side of the barrel for engagement with the fuse carrier which in turn is in electrical contact with the other end of the fuse. The body of the side terminal is disposed on the exterior of the barrel and, in conjunction with the wall of the barrel, isolates the interior of the barrel from the body of the side terminal such that only that portion of the side terminal required to complete the electrical path from the fuse carrier to the side terminal is exposed interior the barrel.

36 Claims, 7 Drawing Sheets

FUSE HOLDER

RELATED APPLICATION

This is a continuation-in-part of U.S. patent application Ser. No. 173,410, filed Mar. 25, 1988.

BACKGROUND OF THE INVENTION

This invention relates to post-type fuse holders and more particularly to fuse holders in which the side terminal is assembled from the exterior of the barrel of the fuse holder and the connection between the side terminal and fuse carrier is disposed interior of the barrel without unduly exposing the side terminal to the interior of the barrel.

A post-type fuse holder is a device for retaining an electrical fuse in a wired circuit. A standard post-type fuse holder is comprised of a barrel, a cap, and means for electrically connecting the fuse holder and fuse, which the fuse holder retains, to an electrical circuit. Commonly, the means for connecting the fuse holder to a circuit is a male terminal which is sized to fit standard female wiring terminals. The fuse holder operates by electrically insulating the fuse from the environment exterior the fuse holder while creating an electrically conductive circuit from one terminal, through the fuse holder and fuse, to the second terminal The fuse holder is typically constructed into cap and barrel sections, and incorporates some means for disassembly to facilitate removal and replacement of the fuses.

Two types of cylindrical fuses are commonly used to fuse circuits to which this invention applies. The first type is the American-style fuse, which is a cylinder approximately ¼ of an inch in diameter and 1¼ inches in length. The other is the European-style fuse, which is approximately 5 mm in diameter and 20 mm in length. Fuse holders are commonly constructed to hold both types of fuses, although the European-style is both shorter and slimmer than the American-style fuse.

One type of fuse holder known in the prior art has a fuse holding barrel which retains one end of a fuse and two electrical wiring access terminals, and a cap which retains the other end of the fuse and completes the electric path between the two electrical access terminals when the cap is inserted in the barrel. To facilitate the contact with the fuse, the bottom terminal is connected to the base of the barrel with a protrusion projecting interior the barrel, and the side terminal is placed interior the barrel and has a protrusion which projects through the wall of the barrel for wiring access. The cap contains an integral conductor which both physically and conductively engages the fuse, and which upon assembly of the cap and fuse within the barrel completes an electric circuit by conductively engaging the side terminal inside the barrel. To reduce the risk of shock and arcing which could occur when the fuse holder cap is removed, and to meet safety standards, an insulating sleeve or spacer-sleeve is disposed interior the barrel between the fuse and the barrel wall, such that only the portion of the side terminal substantially in contact with the cap conductor is exposed to the interior of the barrel. Thus, this type prior art fuse holder, disposing the side terminal within the fuse holder, requires an internal spacer-sleeve to insure that the fuse holder is shock proof, i.e., that the internal exposed live metal is not accessible to the user when holding the fuse carrier with the fuse installed or with the standard I.E.C. test finger. When the spacer sleeve is used, the sleeve must first be assembled to the side terminal, and then the subassembly must be guided blindly into a receiving aperture inside the fuse holder barrel. Where the side terminal is exposed to the interior bore of the barrel, a foreign object inserted into the barrel can make electrical contact with the side terminal U.S. Pat. No. 4,448,476 describes a type of fuse holder which does not use the insulating sleeve. Rather, the bottom and side terminals are molded into the body of the barrel such that only the contact points of the bottom and side terminals are exposed interior the barrel This reduces the risk of shock or arcing when a fuse is inserted or removed from the fuse holder.

U.S. Pat. No. 3,891,292 also discloses a fuse holder having side and bottom terminals with an insulating sleeve located within an interior tubular contact. The side terminal is located within the barrel in this construction by placement from within the barrel through an aperture located in an undercut on the exterior of the body. Electrical contact from the side terminal to the fuse is maintained through a tubular contact and through a conductive spring to a fuse. A circular lip in the interior of the barrel isolates the side terminal from the interior of the barrel, and an insulating sleeve disposed interior the tubular contact electrically isolates the tubular contact from the interior of the fuse holder.

Some prior art fuse holders have a side terminal which is assembled from the outside of the fuse holder, but their point of electrical contact to the fuse carrier is also exposed on the outside of the assembled fuse holder. Such an assembly makes the connection between the side terminal and fuse carrier susceptible to contamination from foreign particles, corrosion, or damage during handling or assembly Other prior art fuse holders have a side terminal which is assembled from the outside of the fuse holder, but do not have a cap which is substantially fully retained within the fuse holder barrel, and the point of making electrical contact is outside the barrel or the assembly requires the use of a sleeve.

Another problem associated with post-type fuse holders is stress relieving which occurs in the metal components therein. This is a particular problem with the cap portion of the fuse holder, which holds a metal fuse carrier inside which must grip the fuse when the cap is removed from the fuse holder barrel. Typically, the fuse carrier includes a tangentially inward projecting flap which serves the dual function of retaining a spring within the cap to bias the fuse against the bottom terminal and grip the end cap of the fuse. During the removal of the fuse from the fuse holder barrel, the friction between the flap and fuse end cap caused by the spring force tending to restrain the outward force of the end cap against the flap holds the fuse in the end cap. However, during the life of the fuse holder, heat cycling caused by the heating of the fuse during short term circuit overloads causes stress relieving in the flap, thereby reducing the spring pressure holding the fuse in the fuse carrier. Thus, it is not uncommon in older fuse holders for the fuse to remain in the fuse holder after the cap and fuse carrier are removed. As a result, the user of the fuse holder must remove the fuse by hand, which could result in a shock to the user.

SUMMARY OF THE INVENTION

The fuse holder for receiving a cylindrical fuse having conductive ends includes a cap having a fuse carrier disposed in part therein for receiving one end of the fuse and a barrel having a fuse cavity for receiving the cap and fuse. The fuse carrier includes a spring retainer for retaining the fuse within the fuse carrier. The barrel includes a bottom terminal extending through the barrel for contact with one conductive end of the fuse and a side terminal having tines extending through apertures in the side of the barrel and housed within tine retainer compartments for engagement with the contacts of the fuse carrier which in turn is in electrical contact with the other end of the fuse. The body of the side terminal is assembled and thus disposed on the exterior of the barrel. The interior wall of the barrel includes the tine retainer compartments for receiving the contacts of the side terminal to isolate the interior of the barrel from the body of the side terminal such that only that portion of the side terminal required to complete the electrical path from the fuse carrier to the side terminal is exposed to the interior the barrel.

The object of this invention is to provide a fuse holder for shielding the contacts of the side terminal from the interior of the barrel to prevent premature electrical connection. Further, the fuse holder is comprised of a minimum of parts and the cap is retained substantially within the barrel. The side terminal is assembled from outside the inner barrel and makes electrical contact within the barrel and which, in conjunction with the fuse holder barrel, eliminates the need for an insulating sleeve. Further, although the side terminal is assembled from outside the barrel, the electrical connection between the side terminal and fuse carrier is disposed inside the barrel.

BRIEF DESCRIPTION OF THE DRAWINGS

The above and other objects and advantages of the present invention will become apparent from the following description when read in conjunction with the accompanying drawings, wherein.

DESCRIPTION OF THE PREFERRED EMBODIMENT

Figure 1:
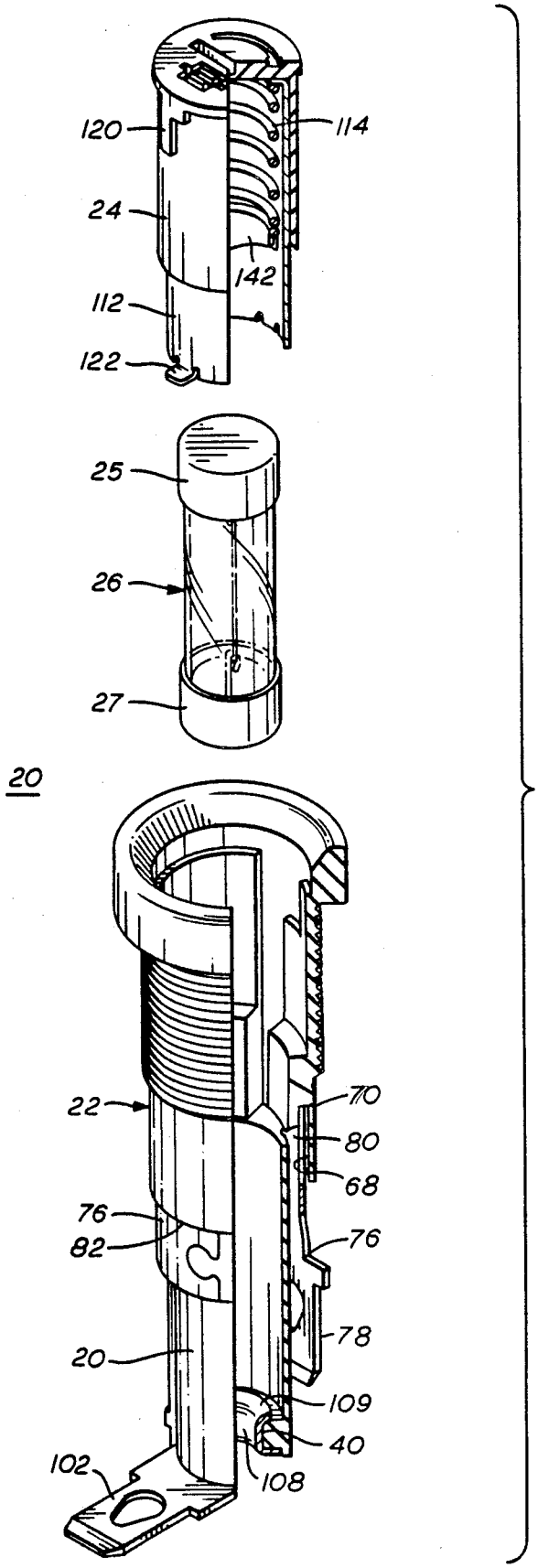
FIG. 1 is an exploded view, partially in section, of the fuse holder showing the alignment of the cap, fuse and barrel.

Referring initially to FIG. 1, the fuse holder 20 of the present invention includes a barrel 22 having a side terminal 76 mounted on its exterior and a bottom terminal 102 disposed on one terminus of the barrel 22, and a cap 24 having a fuse carrier 112 received in part therein and a spring 114 disposed within the cap 24. A pair of undercut portions 75, 77 are molded into the interior of the barrel to receive the side terminal 76. One end 25 of an American-style fuse 26 is received within the fuse carrier 112 and is in electrical contact therewith. Simultaneously the fuse 26 abuts against the end of the spring 114. The cap 24, with the fuse disposed therein, is received within the barrel 22 of fuse holder 20. The other end 27 of the fuse 26, opposite the spring 114, conductively engages the bottom terminal 102 having a ferrule 108 projecting through the bottom of the barrel 22 so as to be exposed for contact with the fuse 26. Likewise, the side terminal 76 includes tines 80, 82 projecting through the side of the barrel 22 into undercut portions 75, 77. Tines 80, 82 engage the fuse carrier 112 inside the barrel 22 to complete the electric circuit The portions of tines 80, 82 are thus isolated from the interior of barrel 22, such that only the portion of tines 80, 82 necessary to interconnect with fuse carrier 112 are exposed to the inner portion of barrel 22. The engagement of the fuse carrier 112 with the tines 80, 82 connects the cap 24 within the barrel 22. The spring 114 insures electrical contact of the fuse 26 within the fuse carrier 112 and barrel 22. The undercut portions 75, 77 eliminate the need for an insulating sleeve.

Figure 2:
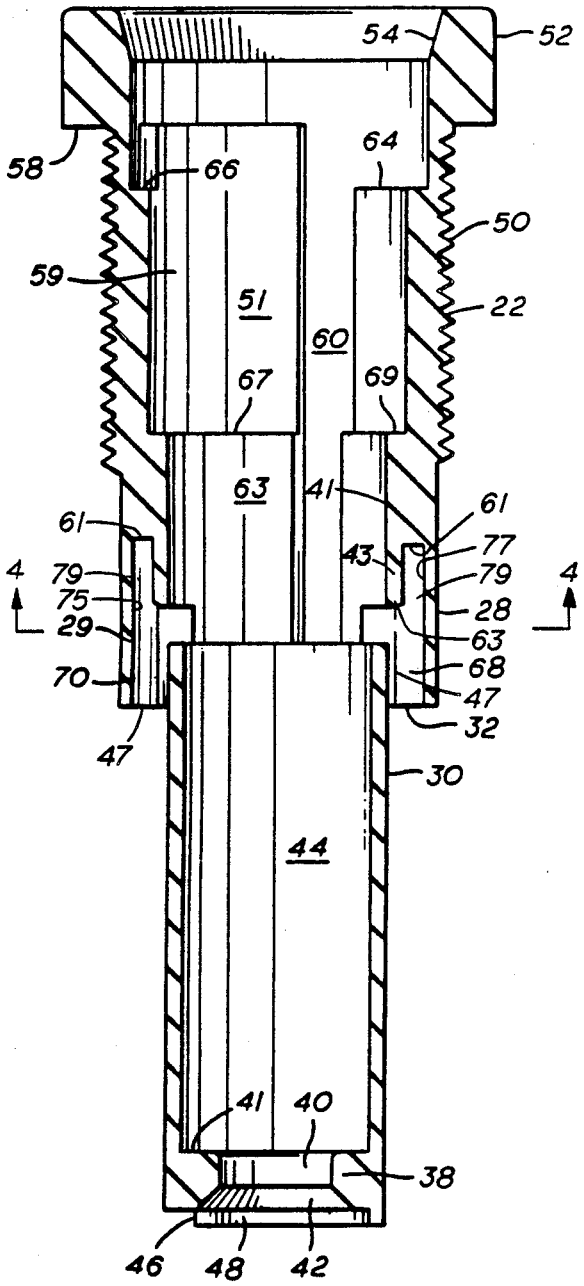
FIG. 2 is a cross-sectional view of the fuse holder barrel shown in FIG. 1.
Figure 3:
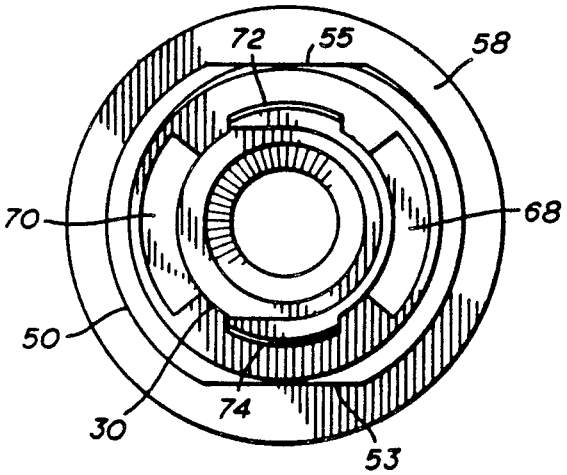
FIG. 3 is an bottom view of the fuse holder barrel shown in FIG. 2.

Referring now to FIGS. 2 and 3 illustrating the barrel 22 of the fuse holder 20, the barrel 22 is preferably made of plastic and has a generally tubular-shaped body. The body of the barrel 22 includes a major diameter tubular portion 28 and a minor diameter tubular portion 30. At the time of the molding of the body of barrel 22, the major diameter portion 28 and minor diameter portion 30 are designed to overlap at 29 ad to form an annular wall 32.

The major diameter tubular portion 28 includes a generally cylindrical interior bore 51 for receiving the cap 24. The major diameter portion 28 includes a head at the tapered entrance or mouth 54 of the bore 51. The tapered entrance 54 facilitates the insertion of the cap 24 into the bore 51. The mounting section 52 of barrel 22 is circular in cross-section and has an enlarged diameter so as to form an annular bearing surface 58. Exterior threads 50 are disposed on the external surface of the major diameter portion 28 for mounting in a electrical panel. Two longitudinal anti-rotation flats 53, 55 are provided over the external threads 50 on each side of the major diameter portion 28. Upon mounting the fuse holder 20 into an electrical panel (not shown), the electrical panel has corresponding anti-rotation flats in its receiving aperture whereby upon inserting the barrel 22 into the aperture of the electrical panel, the anti-rotation flats 53, 55 mate with the flats in the aperture of the electrical panel to prevent rotation of the barrel 22 within the panel aperture. The barrel 22 is inserted into the aperture of the electrical panel such that the bearing surface 58 bears against one side of the electrical panel since the cap 52 has a diameter greater than that of the panel aperture A nut, not shown, is threaded onto the exterior threads 50 until tight from the other side of the panel, the anti-rotation flats preventing the barrel 22 from rotating while the nut is being secured. The nut bears on the rear of the panel to secure the fuse holder 20 to the electrical panel. Opposed secondary flats 57 are provided to allow the use of a snap band (not shown), rather than a nut as described above, which snaps over and engages flats 57 to secure the fuse holder 20 to the panel.

The interior bore 51 of major tubular diameter portion 28 is configured to receive and house the fuse carrier 112 and fuse 26. The interior cylindrical wall 41 of the bore 51 includes alternating alignment bosses 59, 61 forming slots 60 for receiving the contacts 122, 140 of the fuse carrier 112 and to attach the cap 24 within the barrel 22 as hereinafter described in further detail. The alignment bosses 59, 61 do not have a common inner diameter the entire length of interior bore 51 but include smaller diameter portions which form ledges 67, 69 and traversing slots 63, 65. Arcuate ledges 64, 66 are provided in alignment bosses 59, 61, respectively, adjacent the mouth 54 for the purpose of guiding the contacts 122, 140 of the fuse holder 112 into the longitudinal slots 60. The arcuate ledges 64, 66 in alignment bosses 59, 61 abut the outer terminal end of fuse carrier 112 to limit the reception of carrier 112 into internal bore 51.

As shown in FIG. 2, arcuate apertures 68, 70 are provided in barrel 22 extending through the overlap 29 between the major tubular diameter portion 28 and minor tubular diameter portion 30. These apertures 68, 70 extend through the annular wall 32 and into undercut portions 75, 77, respectively. Undercut portions 75, 77 form a pair of arcuate tine retainer compartments 79 for housing tines 80, 82 of side terminal 76, as hereinafter described.

Arcuate tine retainer compartments 79 are arcuate slots formed by undercut portions 75, 77 in barrel 22 for housing tines 80, 82 of side terminal 76. Cylindrical wall 41 forming bore 51 extends downwardly towards apertures 68, 70 into annular guide wall 43. An annular gap 47 is formed between the terminal end of annular wall 43 and the terminal end of minor tubular diameter portion 30 of barrel 22 for the passage of contacts 122, 140 of fuse holder 112. Tine compartments 79 are disposed between annular guide wall 43 and the outer wall of barrel 22. Each compartment 79 terminates in an upper terminal arcuate wall 61 which serves to limit the reception of tines 80, 82 through apertures 68, 70 and into tine compartments 79. Each tine retainer compartment 79 further includes a lead portion 63 adjacent longitudinal slot 60 for aligning tines 80, 82.

Minor tubular diameter portion 30 is illustrated in FIGS. 2 and 3. Minor diameter portion 30 includes a generally tubular shaped body having a blind bore for a fuse cavity 44. The diameter of the fuse cavity 44 is sized such that the fuse 26 can be easily inserted into the cavity without binding. The closed end 38 of minor tubular diameter portion 30 includes an aperture 40 for receiving the ferrule 108 of the bottom terminal 102. The aperture 40 includes a crimp retainer 41 and counterbore 42 corresponding to the shape of the ferrule 108 and end of the bottom terminal 102 whereby that portion of the bottom terminal 102 is recessed into the blind end 38 of minor tubular diameter portion 30. The end 38 is generally circular and has a gap 46 and flange 48 conformed to receive that portion of the bottom terminal 102 as shown in FIG. 1.

Figure 5:
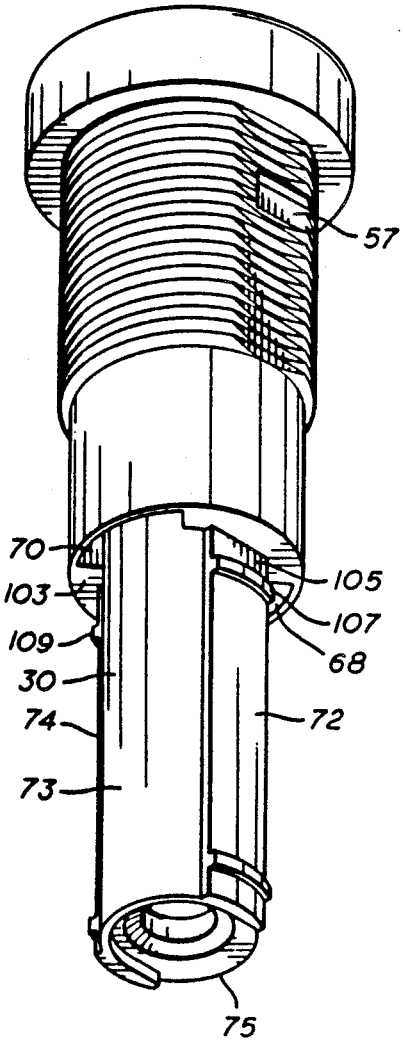
FIG. 5 is a perspective view of the fuse holder barrel shown in FIG. 2.

As shown in FIG. 5, the external surface of minor tubular diameter portion 30 includes two longitudinal alignment splines 72, 74 diametrically opposed from each other. The alignment splines 72, 74 form slots 71, 73 which are aligned with apertures 68, 70. The crimp band 84 of the side terminal 76 is shaped so as to conform with the splines 72, 74 and slots 71, 73 whereby the tines 80, 82 are guided into apertures 68, 70, as hereinafter further described. The alignment splines 72, 74 include crimp shoulders 107, 109 and crimp recesses 103, 105 to receive the crimp section 92 of the crimp band 84 upon crimping crimp band 84.

Figure 6:
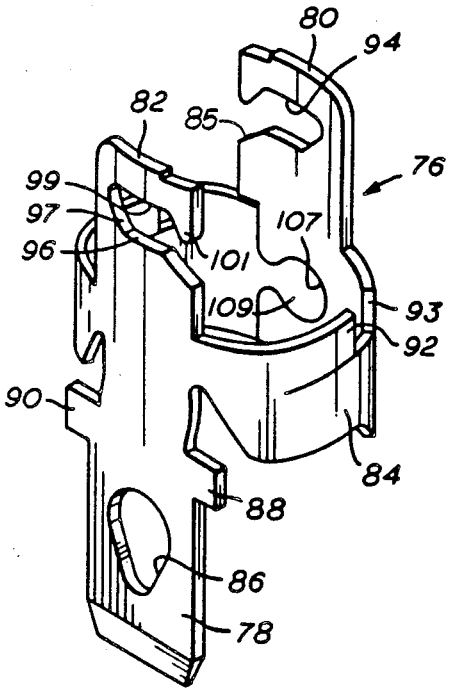
FIG. 6 is a perspective view of the side terminal shown in FIG. 1.

Referring now to FIG. 6, the side terminal 76 is made of a copper-alloy, such as brass or other electrically conductive metal, and includes the tines 80, 82 and an electrical connector 78 extending from the crimp band 84. The tines 80, 82 are arcuate-shaped rectangular ears projecting from the crimp band 84. The tines 80, 82 are sized and shaped to be received through arcuate apertures 68, 70 and into arcuate tine retainer compartments 79 of barrel 22. Tines 80, 82 are circumferentially disposed on the crimp band 84, approximately 180° apart. The free ends of the tines 80, 82 include cutouts or J-slots 94, 96 for alignment with gaps 47 and for receiving the contacts 122, 140 of the fuse carrier 112. The J-slots 94, 96 traverse the longitudinal dimension of the tines 80, 82 and are shaped to receive and engage the contacts 122, 140.

Figure 4:
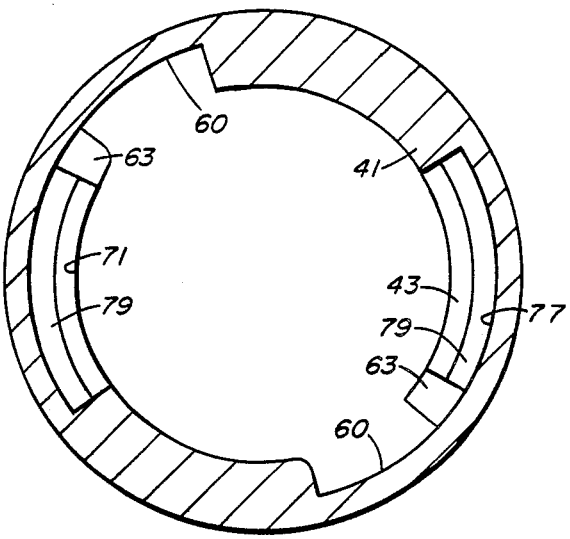
FIG. 4 is a cutaway cross-sectional view of the fuse holder at section 4—4 of FIG. 2.
Figure 4A:
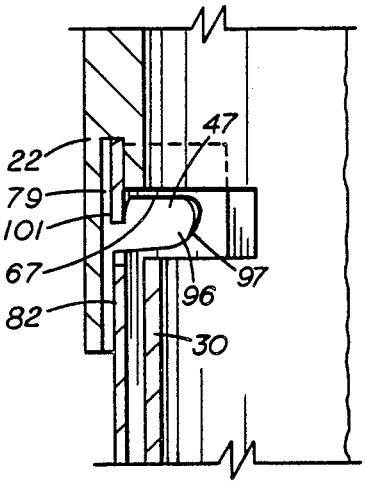
FIG. 4A is a partial side cross-sectional view of the contacts of the side terminal inserted into the tine compartments shown in FIG. 2.

Referring now to FIG. 4A, upon assembly of side terminal 76 and barrel 22, the crimp band 84 receives minor tubular diameter portion 30 with tines 80, 82 being inserted into arcuate tine retainer compartments 79. J-slots 94, 96 of tines 80, 82 are disposed in circumferential alignment with contact access gaps 47 whereby gap 47 and J-slots 94, 96 may simultaneously receive contacts 122, 140. J-slots 94, 96 are slightly smaller than gaps 47 such that an upper lip 67 of tines 80, 82 is exposed for electrical engagement with contacts 122, 140.

By housing tines 80, 82 within annular tine retainer compartments 79, annular wall 43 shields tines 80, 82 from the interior of bore 51 Thus, if an object were inadvertently inserted into bore 51, the angle of bore 51 would not permit the object to engage tines 80, 82 and establish electrical contact so as to short out the fuse. Although a small portion of tines 80, 82, such as lip 67, is exposed to bore 51, that portion is too far recessed behind wall 43 to allow electrical contact with a foreign object inserted into bore 51. Tines 80, 82 are, in effect, isolated from the interior of the upper diametrical portion 28.

Referring again to FIGS. 1 and 2, fuse carrier 112 with contacts 122, 140 is inserted into bore 51. Contacts 122, 140 are received by longitudinal slots 60 until cap 24 engages ledges 64, 66. As contacts 122, 140 bottom out in slots 60 from insertion of fuse carrier 112 into barrel 22, lead portion 63 is open to slots 60, permitting clockwise rotation of fuse carrier 112 to actuate contacts 122, 140 into slots 79. As cap 24 is rotated, contacts 122, 140 are simultaneously received by gaps 47 and J-slots 94, 96. An entry cam surface 98 is provided at the entrance of J-slots 94, 96 to facilitate the reception of the contacts 122, 140 into the J-slots 94, 96.

An inner cam surface 97 is provided to guide the contacts 122, 140 to the upper edge 99 of J-slots 94, 96 whereby a projecting ear 101, extending into the J-slots 94, 96 at the mouth of J-slots 94, 96 will engage the corresponding edges of contacts 122, 140 to prevent the removal of the contacts 122, 140 from J-slots 94, 96 upon the mere rotation of the fuse carrier 112 within barrel 22. Ears 101 will require that the fuse carrier 112 is first moved longitudinally downward into the barrel 22 and then rotated to achieve the disengagement of contacts 122, 140 from J-slots 94, 96.

The electrical connector 78 extends from the crimp band 84 on a side opposite one of the tines 80, 82. The electrical connector 78 includes a teardrop-shaped aperture 86 for the receipt and soldering of an electrical wire to be attached to the fuse holder 20. Ears 88, 90 extend from electrical connector 78, which serve as limit stops for the entry of a female terminal onto the connector 78.

The crimp band 84 is bent into a shape to conform to the external surface of minor tubular diameter portion 30 of barrel 22. The crimp band 84 is generally oval. The ends of the crimp band 84 are attached by a slot 107 and head 109. The sides of the crimp 84 between the tines 80, 82 include crimp sections 92 to assist in the collapse of crimp band 84 so as to conform to the external shape of the minor tubular diameter portion 30 of barrel 22 upon assembly A small cut-away or slot 93 is provided at the end of the crimp sections 92 to assist in the crimping of the crimp band 84 around portion 30.

Figure 7:
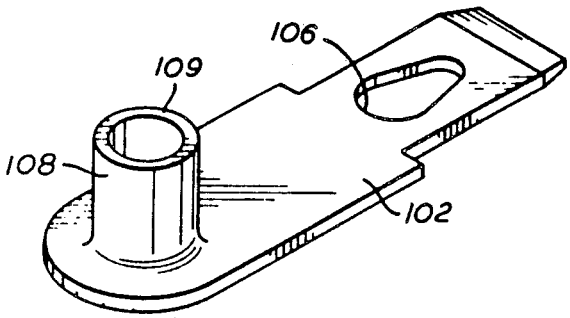
FIG. 7 is a perspective view of the bottom terminal shown in FIG. 1.

Referring now to FIG. 7, the bottom terminal 102 is made of an electrically conducting metal and includes a ferrule 108 projecting from one end of a rectangular-shaped strip of the metal. The free end of the ferrule 108 includes a rolled edge 109 to facilitate its insertion into aperture 40 in the end of barrel 22. The ferrule 108 is cylindrical-shaped. The bottom terminal 102 also includes a teardrop-shaped aperture 106 for receiving and soldering a wire to be connected to the fuse holder 20. The spade terminals or connector 78 of terminal 76 and the connector of terminal 102 may be varied in size and shape and yet fulfill the objectives of the present invention.

Figure 8:
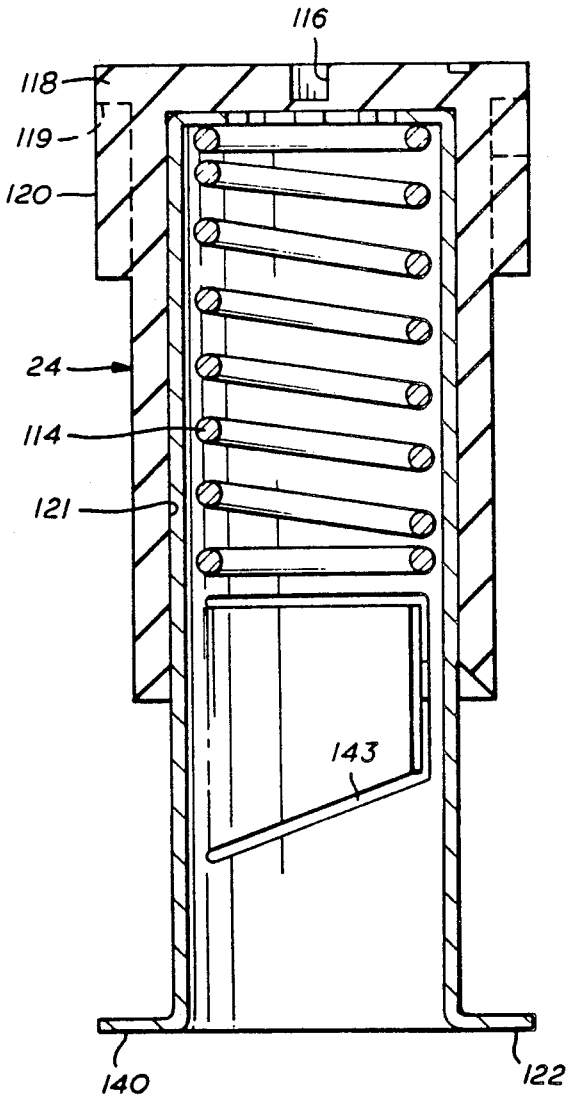
FIG. 8 is a cross-sectional view of the cap, spring, and fuse carrier shown in FIG. 1.

Referring now to FIG. 8, there is illustrated the cap 24, fuse carrier 112, and spring 114. The cap 24 includes an enlarged diameter portion or head 118 forming a bearing surface 119 for engagement with the upper end of alignment bosses 59, 61 to limit the insertion of the cap 24 into the barrel 22. The cap 24 further includes on its exterior surface, adjacent head 118, two L-shaped shoulders 120. The longitudinal portion of shoulder 120 is in alignment with the contacts 122, 140 of fuse carrier 112. Thus, the shoulder 120 is received within the slots 60 between alignment bosses 59, 61. A slot 116 is provided in the head 118 for the insertion of a tool, such as a screwdriver, to rotate the cap 24 within the barrel 22. The cap 24 includes a blind bore 121 for receiving the fuse carrier 112.

Referring now to FIGS. 8, 9, 12, 13, and 14, the fuse carrier 112 is made from an electrically conductive metal strip of a shape retaining metal, such as bronze or brass, which has been rolled and connected by interdisposed ears and slots 123, 125. The fuse carrier 112 is cylindrical in shape and is sized to receive the fuse 26. The end of the fuse carrier 112 received within the cap 24 includes a plurality of roll crimps 126 which, together With the end of the fuse carrier 112, are glued to the inside surface of the head 118 of the cap 24 to attach the fuse carrier 112 within the cap 24. Roll crimps 126 act as a bearing surface against one end of the spring 114; otherwise, the spring would bear directly on the head 118 and would tend to unseat and detach the fuse carrier 112 glued to the head 118. The exposed free end of the fuse carrier 112 includes a pair of ears or contacts 122, 140, which as previously described, are received within the slots 60 of the barrel 22 for rotation into J-slots 94, 96 of tines 80, 82. The fuse carrier 112 further includes a spring retainer 142 for retaining the spring 114 within the fuse carrier 112, and a retaining rib 210, best shown in FIG. 2, to ensure fuse gripping during fuse replacement. The spring retainer 142 includes a U-shaped cutout 143 in the form of a flap in the side of fuse carrier 112 which can be bent inwardly to reduce the inner diameter of fuse carrier 112 after spring 114 has been inserted into the bottom of carrier 112 so as to retain the spring 114 within the carrier 112. The inward bending of the spring retainer 142 also reduces the inner diameter of the fuse carrier 112 to create a slight interference between the spring retainer 142 and the standard American fuse 26 thereby assisting in retaining the fuse 26 within the fuse carrier 112.

Retaining rib 210 is a longitudinal inwardly projecting sliver of metal which is a continuation of the outer surface 208 of fuse carrier 112. Rib 210 is formed by stamping a pair of slots 212 through outer surface 208 adjacent rib 210 and punching rib 210 below fuse carrier 112 outer face 208 prior to assembly of fuse carrier 112 into tubular barrel 22. Rib 210 includes rib ends 214, which blend into outer surface 208, and a support spring portion 216 between ends 214. The rib end 214 adjacent the open end of fuse carrier 112 forms a retaining nib which is disposed adjacent the glass portion of fuse 26 after the fuse 26 is inserted into the fuse carrier 112. Rib 210 is disposed within fuse carrier 112 opposite spring retainer 142, and extends radially inward fuse carrier 112 approximately .025 inches. When fuse 26 is inserted in fuse carrier 112, the rib end 214 is not stressed. Thus, even if stress relieving occurs in the rib end 214, the rib end does not deform and engages the underside of end cap 25 to pull fuse 26 out of barrel 22 when fuse carrier 112 is removed from barrel 22.

Figure 14:
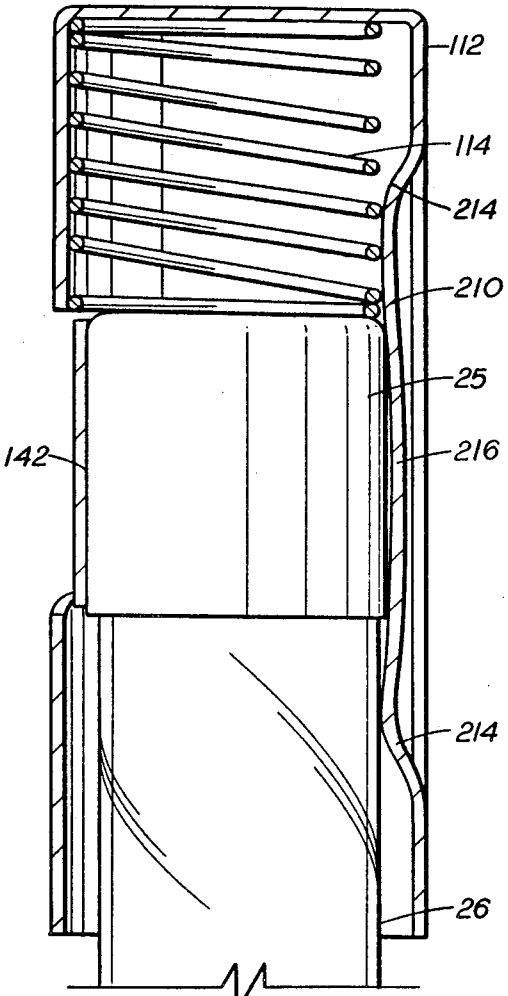
FIG. 14 is a cutaway side view of the fuse carrier of FIG. 13 receiving a fuse therein.
Figure 13:
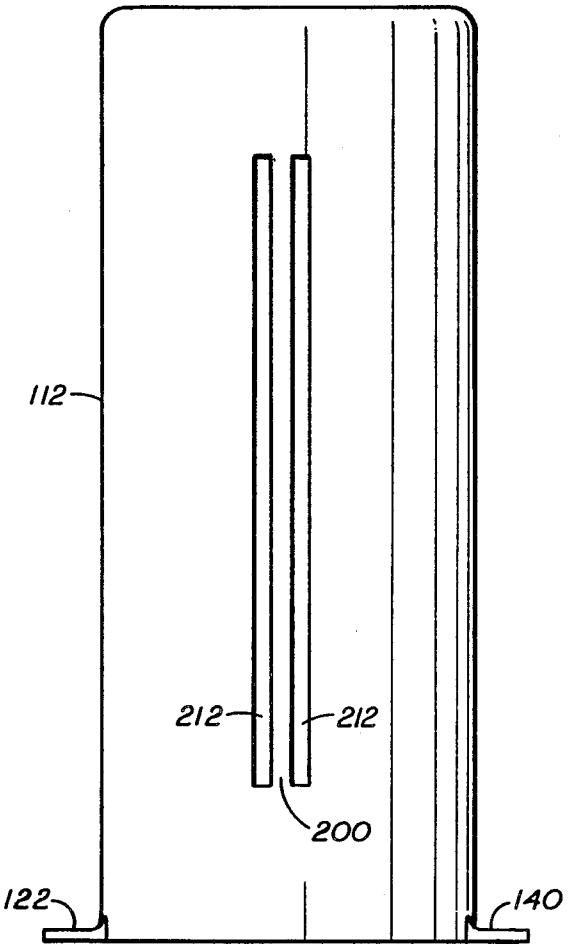
FIG. 13 is a side view of the fuse carrier shown in FIG. 12.
Figure 12:
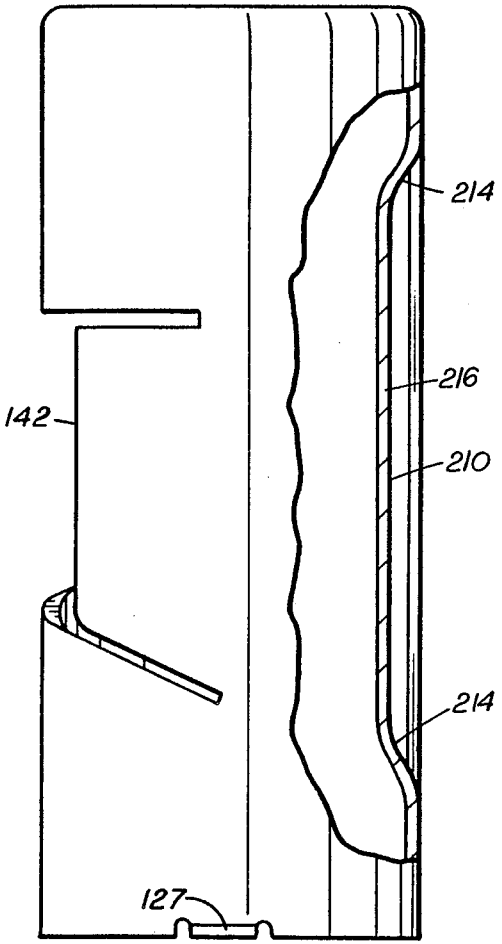
FIG. 12 shows a partial cutaway view of the fuse carrier shown in FIG. 10.

Referring to FIG. 14, fuse 26 includes end cap 25 at one end thereof which is received within fuse carrier 112. End cap 25 is disposed between rib ends 214 and deforms spring portion 216 radially outward toward outer surface 208. End cap 25 is pressed against rib 210 by spring retainer 142. During the course of the life of the fuse holder 20, fuse 26 and fuse carrier 114 will be repeatedly heated and cooled, and the stress causing the inward spring action of the spring retainer 142 will relieve, thereby reducing the friction between the end cap 25 and spring retainer 142. However, rib end 214 will hold fuse 26 in place within fuse carrier 112 as it is removed from barrel 22, thereby eliminating the possibility of the fuse 26 being retained within barrel 22 as carrier 112 is removed and thus having to remove the fuse separately with an ungrounded tool. Further, the improved fuse carrier is reusable even after stress relieving has occurred. Rib end 214 extends sufficiently into the inner diameter of fuse carrier 112 such that upon insertion of fuse 26 into fuse carrier 112 end cap 25 is cammed behind rib end 214. Rib end 214 does not take a set from stress relieving because it is not deformed during the heating and cooling cycle.

Referring again to FIG. 1, upon assembly of the bottom terminal 102 and the side terminal 76 into the barrel 22, the ferrule 108 of the bottom terminal 102 protrudes through the bore 40 of barrel 22, and is crimped into place by diametrical expansion of the rolled edge 109 such that rolled edge 109 of ferrule 108 has a diameter greater than that of the bore 40. Tines 80, 82 of the side terminal 76 protrude through apertures 68, 70, respectively, and into tine retainer compartments 79 such that slots 94, 96 are disposed in alignment with access gaps 47. The side terminal 76 is secured to barrel 22 by diametrically inward deformation of crimp sections 92 into crimp recesses 103, 105. The ovoid cross-section of the side terminal 76 in conjunction with the alignment splines 72, 74 facilities the alignment of the tines 80, 82 with the apertures 68, 70, and crimp sections 92 with crimp recesses 103, 105. Tines 80, 82 are retained within tine retainer compartments 79 in undercut portions 75, 77. The cap 24 is pressed over the end 25 of the fuse 26, and the protruding portion of the fuse carrier 112 and the fuse 26 are inserted into the bore 51 of major diameter portion 28 of the barrel 22. The contacts 122, 140 and shoulder 120 of the cap 24 are aligned with, and fit into slots 60 of the barrel 22. The cap 24 is inserted until the fuse carrier 112 bottoms out, and is then turned in a clockwise direction such that contacts 122, 140 actuate through access gaps 47 and protrude into the J-shaped slots 94, 96. Cap 24 is thus nearly fully deployed within barrel 22. The opposite end 27 of the fuse 26 bears on the rolled edge 109 of ferrule 108. Thus, a continuous circuit is established from first conductor or bottom terminal 102 through the fuse 26 into the fuse carrier 112, through contacts 122, 140, and thereby to the second conductor or side terminal 76. The cap 24 may be turned by the use of a tool, such as a screwdriver, using the slot 116. The fuse 26 may be removed by depressing the cap 24 and rotating in a counterclockwise direction.

Figure 9:
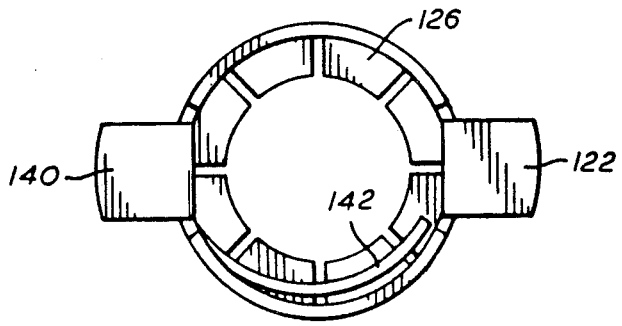
FIG. 9 is a bottom view of the fuse carrier shown in FIG. 8.
Figure 10:
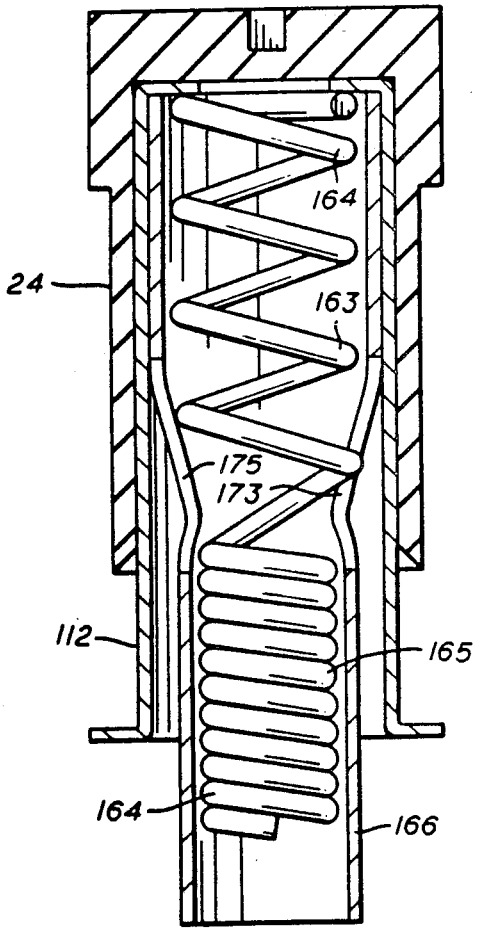
FIG. 10 shows an alternative embodiment of the present invention designed for European-style fuses.
Figure 11:
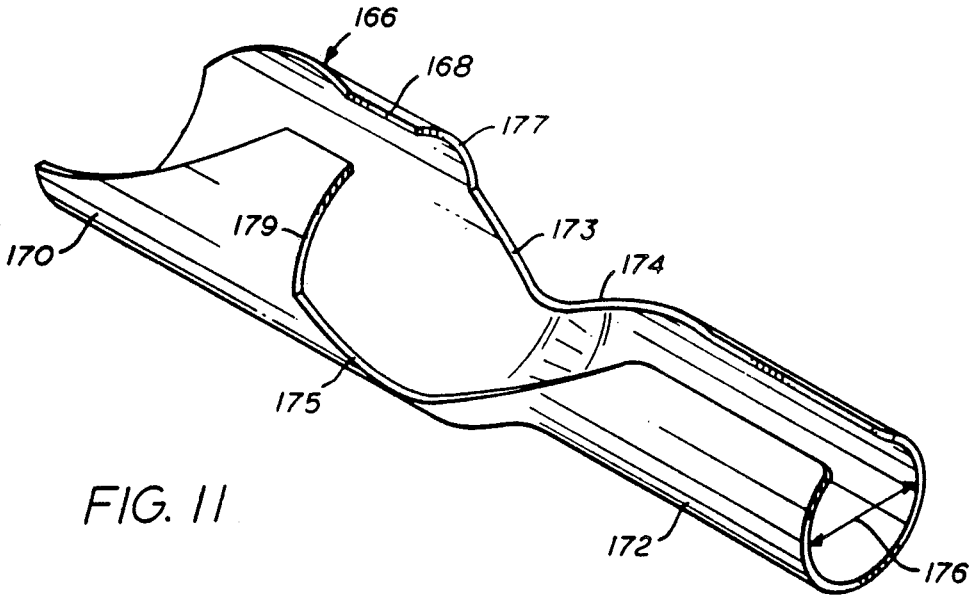
FIG. 11 shows the construction of the adaptor sleeve of the alternative embodiment shown in FIG. 10 used in conjunction with European-style fuses.

Referring to FIGS. 9 and 10, an alternative embodiment of the present invention is shown for use with a European-style fuse. An adaptor sleeve 166 is located within cap 24 and radially disposed between the fuse carrier 112 and extended spring 164. Adaptor sleeve 166 is circular, having a longitudinal cutout 168, major adaptor diameter 170, minor adaptor diameter 172, and taper 174 which blends between major adaptor diameter 170 and minor adaptor diameter 172. Taper 174 further has cutouts 173, 175 and engagement flats 177, 179. Long pitch spring 163 is located interior major adaptor diameter 170, and protrudes through cutouts 173, 175 where it blends into short pitch spring 165 which is disposed interior minor adaptor diameter 172. Extended spring 164 is continuous and comprised of long pitch spring 163 and short pitch spring 165. The inner diameter of minor adaptor diameter 172 is sized such that when European style fuse is inserted therein, a slight interference occurs between the fuse and the inner minor adaptor diameter 176. Engagement flats 177, 179 engage the underside of retainer 142, shown in FIG. 7, to retain the adaptor sleeve 166 within the fuse carrier 112. Thus, when the cap 24 is removed, the fuse will maintain contact with the cap 24 for removal from the fuse holder 20. The adaptor sleeve 166 is further longitudinally sized such that when the European fuse is inserted therein and the cap 24 is inserted into the barrel as shown in FIG. 1, the end of the European fuse opposite the cap 24 makes contact with the bottom terminal 102. Extended spring 164 maintains pressure on the European fuse. When the fuse holder 20 is used with a European fuse, only the configuration of the cap as described herein is changed.

Figure 15:
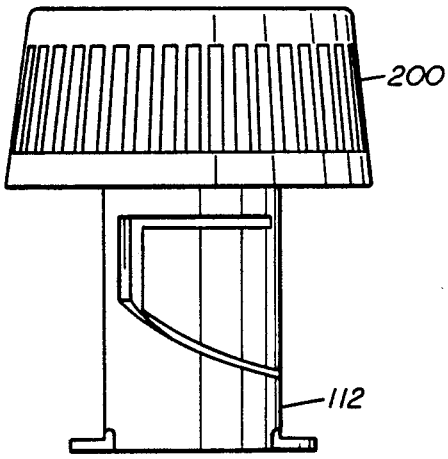
FIG. 15 shows an alternative cap construction for use with the present invention.

Referring to FIG. 15, an alternative embodiment of the cap for use in the invention is shown. Fuse carrier 112 is received within knob-style cap 200. Knob-style cap 200 is diametrically larger than barrel 22, and protrudes therefrom upon insertion of fuse carrier 112 into barrel 22.

The present invention provides a fuse holder having fewer components than are required in most fuse holders of the prior art and particularly eliminates the need for an internal spacer sleeve.

The side terminal 76 of the present invention is assembled from the outside of the barrel 22 and the tines 80, 82, projecting through the apertures 68, 70, provide the electrical connecting portion which actually engages and connects with the fuse carrier 112 within the barrel 22. Thus, the connection between the fuse carrier 112 and tines 80, 82 is protected against damage by external means, since it is located inside the barrel 22. Further, the present invention maintains the shockproof feature in that no internal exposed live metal is accessible to the user when holding the fuse carrier with the fuse installed or with the standard IEC test finger. Interior cylindrical wall 41, which is molded as a part of the barrel 22 and extends over tines 80, 82, provides the insulation required to maintain this shockproof feature.

While preferred and alternate embodiments of the invention have been shown and described, modifications thereof can be made by one skilled in the art without departing from the spirit of the invention.

I claim:

1. A fuse holder for receiving a fuse having conductive ends, comprising:

a pre-molded barrel having a bore to receive the fuse, said barrel having at least one arcuate slot circumscribing a portion of said bore and forming an arcuate wall separating said arcuate slot and bore, said arcuate wall having an aperture therethrough;

a bottom terminal disposed at one end of said barrel adapted to conductively engage one end of the fuse;

a side terminal disposed on the exterior of said barrel and having at least one tine protruding into said arcuate slot;

a cap having a fuse carrier adapted for receiving the other end of the fuse, said fuse carrier being received by said bore, said fuse carrier having a first position where said fuse carrier does not project through said aperture into engagement with said side terminal and a second position where said fuse carrier projects through said aperture into engagement with said side terminal within said barrel.

2. The fuse holder of claim 2, wherein said barrel includes a reduced dimensional portion on its exterior for housing said side terminal .

3. The fuse holder of claim 1, wherein said barrel includes a major member and a minor member, said minor member having an external dimension less than that of said major member and said aperture extending through said barrel at the location of a dimension change between said major and minor members.

4. The fuse holder of claim 3, wherein said undercut slot is formed by an annular wall spaced from the outer wall of said barrel.

5. The fuse holder of claim 3, wherein said major member includes at least one undercut adjacent said aperture to receive said tine.

6. The fuse holder of claim 3, wherein said side terminal has a blade terminal projecting therefrom adapted for attaching a wiring terminal thereto.

7. The fuse holder of claim 3, wherein the exterior of said minor member is configured to conform to the contour of said side terminal.

8. The fuse holder of claim 3, wherein said minor member is generally circular and said side terminal has a ring-like body for receiving said generally circular minor member.

9. The fuse holder of claim 8, wherein said side terminal upon assembly on said minor member has an outer dimension less than the outer dimension of said major member.

10. The fuse holder of claim 3, wherein said major member has a fuse carrier cavity for receiving said fuse carrier.

11. The fuse holder of claim 10, wherein said fuse carrier cavity includes means for aligning said fuse carrier within said barrel.

12. A fuse holder for receiving a fuse having conductive ends, comprising:

a pre-molded barrel to receive the fuse, said barrel having at least one aperture therethrough and an arcuate undercut slot aligned therewith within said barrel;

a bottom terminal disposed at one end of said barrel adapted to conductively engage one end of the fuse;

a side terminal disposed on the exterior of said barrel and having at least one tine protruding through said aperture and into said arcuate undercut slot;

a cap having a fuse carrier adapted for receiving the other end of the fuse, said cap and fuse carrier being received by and substantially within said barrel, said fuse carrier engaging said side terminal within said barrel;

said barrel including a major member and minor member, said minor member having an external dimension less than that of said major member and said aperture extending through said barrel at the location of dimension change between said major and minor members;

said undercuts slot being formed by an annular wall spaced from the outer wall of said barrel; and said wall including a guiding means to guide said tine into said undercut slot.

13. A fuse holder for receiving a fuse having conductive ends, comprising:

a pre-molded barrel to receive the fuse, said barrel having at least one aperture therethrough and an arcuate undercut slot aligned therewith within said barrel;

a bottom terminal disposed at one end of said barrel adapted to conductively engage one end of the fuse;

a side terminal disposed on the exterior of said barrel and having at least one tine protruding through said aperture and into said arcuate undercut slot;

a cap having a fuse carrier adapted for receiving the other end of the fuse, said cap and fuse carrier being received by and substantially within said barrel, said fuse carrier engaging said side terminal within said barrel;

said barrel including a major member and a minor member, said minor member having an external dimension less than that of said major member and said aperture extending through said barrel at the location of a dimension change between said major and minor members; and said minor member including means for retaining said side terminal on the exterior of said barrel.

14. The fuse holder of claim 13, wherein said retaining means includes at least one recess for receiving a portion of said side terminal upon said side terminal being deformed.

15. The fuse holder of claim 14, wherein said side terminal has crimps disposed along its body for deformation into said recess to connect said side terminal to said barrel.

16. A fuse holder for receiving a fuse having conductive ends, comprising:

a pre-molded barrel to receive the fuse, said barrel having at least one aperture therethrough and an arcuate undercut slot aligned therewith within said barrel;

a bottom terminal disposed at one end of said barrel adapted to conductively engage one end of the fuse;

a side terminal disposed on the exterior of said barrel and having at least one tine protruding through said aperture and into said arcuate undercut slot;

a cap having a fuse carrier adapted for receiving the other end of the fuse, said cap and fuse carrier being received by and substantially within said barrel, said fuse carrier engaging said side terminal within said barrel;

said barrel including a major member and a minor member, said minor member having an external dimension less than that of said major member and said aperture extending through said barrel at the location of a dimension change between said major and minor members;

said major member having a fuse carrier cavity for receiving said fuse carrier;

said fuse carrier cavity including means for aligning said fuse carrier within said barrel; and said aligning means including at least one longitudinal slot for receiving a portion of said fuse carrier.

17. A fuse holder for receiving a fuse having conductive ends, comprising:

a pre-molded barrel to receive the fuse, said barrel having at least one aperture therethrough and an arcuate undercut slot aligned therewith within said barrel;

a bottom terminal disposed at one end of said barrel adapted to conductively engage one end of the fuse;

a side terminal disposed on the exterior of said barrel and having at least one tine protruding through said aperture and into said arcuate undercut slot;

a cap having a fuse carrier adapted for receiving the other end of the fuse, said cap and fuse carrier being received by and substantially within said barrel, said fuse carrier engaging said side terminal within said barrel;

said barrel including a major member and a minor member, said minor member having an external dimension less than that of said major member and said aperture extending through said barrel at the location of a dimension change between said major and minor members;

said major member including at least one undercut adjacent said aperture to receive said tine; and said major member including a bore having a slot for aligning said fuse carrier, said slot extending past said undercut to guide said fuse carrier into electrical contact with said tine and side terminal.

18. The fuse holder of claim 17, wherein said tine includes a slot for receiving a contact disposed on said fuse carrier.

19. The fuse holder of claim 17, wherein said major member has at least one ledge located within said bore, said ledge being disposed adjacent said slot, said ledge forming the boundary of said undercut opposite said aperture for limiting the reception of said fuse carrier within said barrel.

20. A fuse holder for receiving a fuse having conductive ends, comprising:

a body having adjacent coaxial cylindrical first and second sections and apertures through said body at the junction of said first and section sections and at least one undercut portion forming a blind recess within said first section aligned with said aperture;

a cap adapted to receive the fuse;

a first conductor disposed on said cap and in conductive contact with one end of the fuse;

a second conductor having terminal means adapted for connection to circuit and at least one contact for attaching said second conductor to said first conductor within said body; said contact including a slot portion and a lead portion, aid contact having said lead portion disposed in said undercut portion;

a third conductor conductively engaging the other end of the fuse and having terminal means adapted for connection to the circuit;

said contact protruding through said aperture and into the interior of said body and engaging said first conductor for connecting said cap to said body; and biasing means for biasing the fuse into contact with said first and third conductors.

21. The fuse holder of claim 20 further including an adapter housed within said fuse carrie for receiving a fuse of reduced size.

22. The fuse holder of claim 20, wherein an annular wall is formed by said first and second sections, said aperture being disposed through said wall.

23. The fuse holder of claim 22, wherein said contact includes a J-shaped slot for receiving a protrusion of said first conductor.

24. The fuse holder of claim 22, wherein said undercut portion is formed by an annular web extending from the inner wall of said first section forming a retaining slot therebetween and a tine access gap between said annular web and said second section.

25. The fuse holder of claim 24, wherein said second section includes a spline projecting therefrom and a crimp recess therein adjacent said tine access gap for securing said second conductor on said body.

26. The fuse holder of claim 25, wherein said second conductor includes a crimp disposed thereon, said crimp being disposed within said crimp recess to secure said second conductor to said body.

27. The fuse holder of claim 26, wherein said first section has opposed longitudinal slots within said cavity, said slots located and sized to receive protrusions from said first conductor for alignment with said slot.

28. The fuse holder of claim 27, wherein said cavity has annular ledges disposed between said slots for limiting the reception of said cap within said body.

29. The fuse holder of claim 28, wherein said slots terminate in diametrical undercuts disposed between said ledges and said apertures, said undercuts housing said contact.

30. An improved fuse carrier for use in retaining a cylindrical fuse having a cylindrical body with at least one end ferrule extending radially outward at one end thereof in a post type fuse holder, comprising:

a metallic tubular body;

an inwardly projecting flap on said body;

an inwardly projecting longitudinal rib disposed inward said tubular body;

said rib including a longitudinal spring portion offset from said body and supported inward said tubular body by at least one support nib;

said spring portion offset substantially parallel said body portion prior to insertion of the fuse into said body; and, said nib extending inward said body and under said ferrule adjacent the fuse body portion when the fuse is inserted in the fuse carrier.

31. The improved fuse carrier of claim 30, wherein said rib is opposite said flap.

32. The fuse carrier of claim 30 wherein said tubular body is disposed in a slotted cap.

33. The fuse carrier of claim 30 wherein said tubular body is received within a knob type cap.

34. An improved fuse carrier for use in retaining a fuse in a post-type fuseholder, comprising:

a metallic tubular body;

an inwardly projecting flap on said body;

an inwardly projecting longitudinal rib disposed inward said tubular body in position to retain the fuse in the fuse holder; and said rib including a longitudinal spring portion supported inward said tubular body by opposed inward projecting nib shaped supports.

35. The fuse carrier of claim 34, wherein said rib is a stamped offset of said tubular body.

36. An improved fuse carrier for retaining a cylindrical fuse in an end cap in a post type fuse holder, the fuse carrier having a tubular metal body and inward flap in the body to engage the fuse ferrule, the improvement therein comprising:

a longitudinal rib extending interior said tubular body;

said rib including a rib end projecting inward the metal body a sufficient distance to interferingly engage the ferrule as the ferrule is pulled for the metal body; and an extending rib portion extending rom said rib end to engage and support the ferrule away from the rib end.

* * * * *

UNITED STATES PATENT AND TRADEMARK OFFICE

CERTIFICATE OF CORRECTION

PATENT NO. : 4,981,448

DATED : January 1, 1991

INVENTOR(S) : William G. Herbert

It is certified that error appears in the above—identified patent and that said Letters Patent is hereby corrected as shown below:

Column 2, line 6, after "terminal" insert a --.--.
Column 2, line 11, after "barrel" insert a --.--.
Column 2, line 34, after "assembly" insert a --.--.
Column 4, line 47, change "ad" to --and--.
Column 7, line 25, after "assembly" insert a --.--.
Column 7, line 64, change "With" to --with--.
Column 10, line 51, Claim 2, change "fuse holder of Claim 2" to read --fuse holder of Claim 1--.
Column 13, line 24, Claim 20, change "aid" to --said--.
Column 13, line 37, Claim 21, change "carrie" to --carrier--.
Column 14, line 56, Claim 36, change "rom" to --from--.

Signed and Sealed this

Twenty-ninth Day of September, 1992

*Attest:*

DOUGLAS B. COMER

*Attesting Officer*

*Acting Commissioner of Patents and Trademarks*